US012768058B2

(12) United States Patent
Lee et al.

(10) Patent No.: US 12,768,058 B2
(45) Date of Patent: Oct. 20, 2026

(54) SILVER NANOCLUSTER CATALYST FOR CARBON DIOXIDE CONVERSION, GAS DIFFUSION ELECTRODE INCLUDING SAME, ZERO-GAP REACTOR INCLUDING SAME, AND METHOD OF CONVERTING CARBON DIOXIDE USING THE SAME

(71) Applicant: INDUSTRY-ACADEMIC COOPERATION FOUNDATION, YONSEI UNIVERSITY, Seoul (KR)

(72) Inventors: Dongil Lee, Goyang-si (KR); Hoeun Seong, Seoul (KR); Sojung Lee, Seoul (KR)

(73) Assignee: INDUSTRY-ACADEMIC COOPERATION FOUNDATION, YONSEI UNIVERSITY, Seoul (KR)

( * ) Notice: Subject to any disclaimer, the term of this patent is extended or adjusted under 35 U.S.C. 154(b) by 755 days.

(21) Appl. No.: 18/297,532

(22) Filed: Apr. 7, 2023

(65) Prior Publication Data

US 2023/0340680 A1 Oct. 26, 2023

(30) Foreign Application Priority Data

Apr. 8, 2022 (KR) ..... 10-2022-0043839

(51) Int. Cl.

| | |
|---|---|
| ***C25B 11/085*** | (2021.01) |
| ***C25B 1/23*** | (2021.01) |
| ***C25B 3/26*** | (2021.01) |
| ***C25B 9/23*** | (2021.01) |
| ***C25B 11/032*** | (2021.01) |

(52) U.S. Cl.
CPC ..... *C25B 11/085* (2021.01); *C25B 1/23* (2021.01); *C25B 3/26* (2021.01); *C25B 9/23* (2021.01); *C25B 11/032* (2021.01)

(58) Field of Classification Search
CPC ..... C25B 11/085; C25B 1/23; C25B 3/26
See application file for complete search history.

(56) References Cited

U.S. PATENT DOCUMENTS

2016/0107154 A1 4/2016 Masel et al.

FOREIGN PATENT DOCUMENTS

JP 2021516290 A 7/2021

OTHER PUBLICATIONS

Rais, D. et al., "Anion-Templated Syntheses of Rhombohedral Silver ± Alkynyl Cage Compounds," Angewandte Chemie, vol. 40, No. 18, Sep. 17, 2001, 4 pages.
Alhilaly, M. et al., "Assembly of Atomically Precise Silver Nanoclusters into Nanocluster-Based Frameworks," Journal of the American Chemical Society, vol. 141, No. 24, May 28, 2019, 8 pages.
Qin, L. et al., "Homoleptic Alkynyl-Protected Ag15 Nanocluster with Atomic Precision: Structural Analysis and Electrocatalytic Performance toward CO2 Reduction," Angewandte Chemie, vol. 60, No. 50, Dec. 6, 2021, 6 pages.
(Continued)

*Primary Examiner* — Ciel P Contreras
(74) *Attorney, Agent, or Firm* — McCoy Russell LLP

(57) ABSTRACT

Provided are a silver nanocluster catalyst for carbon dioxide conversion, a gas diffusion electrode including the same, a zero-gap reactor including the same, and a method of converting carbon dioxide showing an excellent conversion rate and high selectivity using the same.

18 Claims, 5 Drawing Sheets

(56) References Cited

OTHER PUBLICATIONS

Rais, D. et al., "Directing role of anions in the syntheses of the silver-alkynyl cages [Ag14(C≡CtBu)12X][BF4] (X=F, Cl, Br) and silver-alkynyl polymers [Ag3(C≡CtBu)2(X)]n (X=Tos, NO3)," Journal of Organometallic Chemistry, vol. 652, No. 1-2, Jun. 1, 2002, 7 pages.
Kim, B. et al., "Over a 15.9% Solar-to-CO Conversion from Dilute CO2 Streams Catalyzed by Gold Nanoclusters Exhibiting a High CO2 Binding Affinity," ACS Energy Letters, vol. 5, No. 3, Dec. 23, 2019, 9 pages.
Seong, H. et al., "Atomically Precise Gold Nanoclusters as Model Catalysts for Identifying Active Sites for Electroreduction of CO2," Angewandte Chemie, vol. 133, No. 26, Apr. 20, 2021, 9 pages.

SILVER NANOCLUSTER CATALYST FOR CARBON DIOXIDE CONVERSION, GAS DIFFUSION ELECTRODE INCLUDING SAME, ZERO-GAP REACTOR INCLUDING SAME, AND METHOD OF CONVERTING CARBON DIOXIDE USING THE SAME

CROSS REFERENCE TO RELATED APPLICATION

The present application claims priority to Korean Patent Application No. 10-2022-0043839 filed on Apr. 8, 2022. The entire contents of the above-listed application are hereby incorporated by reference for all purposes.

TECHNICAL FIELD

The following disclosure relates to a silver nanocluster catalyst for carbon dioxide conversion, a gas diffusion electrode including the same, a zero-gap reactor including the same, and a method of converting carbon dioxide using the same.

BACKGROUND

A nanocluster or superatom composed of a certain number of metal atoms and ligands follows the superatom orbital theory in which a valence electron of particles is newly defined, and is regarded as one giant atom in the theory.

A nanocluster is stable as compared with single atom or nanoparticle and has molecular properties stronger than metallic properties to have optical and electrochemical properties which are completely different from those of nanoparticles. In particular, since the nanocluster has optical, electrical, and catalytic properties which sensitively vary depending on the number of metal atoms, the kind of metal atom, ligands, and the like, studies of the nanoclusters are actively progressing in a wide variety of fields.

Meanwhile, according to population growth and industrialization after the industrial revolution, greenhouse gas emissions have increased due to an increase in fossil fuel use and the concentration of greenhouse gases in the atmosphere increases, leading to global warming phenomena in which earth's average temperature rises. As a result, efforts to reduce carbon dioxide emissions are underway under the 2015 Paris Agreement on Climate Change.

Among them, a carbon dioxide conversion technology by electrochemical reduction is a technology of inputting electrical energy to generate a potential difference between electrodes, thereby reducing carbon dioxide into useful carbon compounds through electron transfer, and is favorable in that a carbon dioxide reduction reaction may be performed even at room temperature and under normal pressure, since raw material required for the reaction are only water and carbon dioxide, chemical materials are not discharged by recycling an electrolyte, and furthermore, the process is simple.

In addition, in the case of a carbon dioxide electrochemical reduction technology, a flow electrolyzer having a gap structure form in which an electrode and a separator are spaced apart by several millimeters was conventionally used, but in recent years, studies to use a zero-gap reactor having a zero-gap structure in a sandwich form in which a positive electrode and a negative electrode are in contact with each other with a separator interposed therebetween, the zero-gap reactor having no gap between an electrode and a separator in order to decrease ionic resistance and reduce an increase in mass transfer resistance due to gas produced in implementation of a large-area electrode, have been carried out.

Since the electrochemical reduction technology as such is highly influenced by reaction conditions such as the kind of electrode catalyst, the properties of an electrolyte, pH, temperature, and pressure, in order to reduce carbon dioxide to convert it into a useful carbon compound, in particular, a study of the type of electrode catalyst and the electrolyte used is needed.

Currently, a gold catalyst is mainly used as an electrode catalyst, but it is expensive and has limited reserves, and thus, a catalyst to replace it is needed.

In addition, development of a catalyst which suppresses a hydrogen generating reaction which is a competing reaction and has an excellent selectivity to a reduction reaction of carbon dioxide is demanded.

RELATED ART DOCUMENTS

[Patent Documents]

(Patent Document 1) Korean Patent Registration No. 10-2372659 B1

(Patent Document 2) U.S. Patent Registration No. 9370773 B2

SUMMARY

An embodiment of the present invention is directed to providing a silver nanocluster catalyst having excellent carbon dioxide conversion performance, a gas diffusion electrode including the same, and a zero-gap reactor including the same.

Another embodiment of the present invention is directed to providing a method of converting carbon dioxide showing excellent conversion performance and excellent selectivity using the zero-gap reactor.

In one general aspect, a silver nanocluster catalyst for carbon dioxide conversion represented by the following Chemical Formula 1 is provided:

$$XAg_{14}(R^1)_{12} \quad \text{[Chemical Formula 1]}$$

wherein $R^1$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, C6-C20 arylalkyl, or S—$R^{11}$;

$R^{11}$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, or C6-C20 arylalkyl; and X is a halogen.

In Chemical Formula 1, $R^1$ may be C1-C10 alkyl, C3-C10 alkenyl, C3-C10 alkynyl, C6-C10 allyl, C3-C10 cycloalkyl, C5-C10 heteroallyl, C3-C10 heterocycloalkyl, C6-C10 arylalkyl, or S—$R^{11}$, $R^{11}$ may be C1-C10 alkyl, C3-C10 alkenyl, C3-C10 alkynyl, C6-C10 allyl, C3-C10 cycloalkyl, C5-C10 heteroallyl, C3-C10 heterocycloalkyl, or C6-C10 arylalkyl, and X may be a halogen.

In addition, in Chemical Formula 1 according to an exemplary embodiment of the present invention, le may be C1-C10 alkyl, C3-C10 alkenyl, C3-C10 alkynyl, C6-C10 allyl, or S—$R^{11}$, $R^{11}$ may be C1-C10 alkyl, C3-C10 alkenyl, C3-C10 alkynyl, C6-C10 allyl, or C6-C10 arylalkyl, and X may be a halogen.

In Chemical Formula 1 according to an exemplary embodiment of the present invention, le may be C1-C10 alkyl, C3-C10 alkenyl, or C3-C10 alkynyl, and X may be a halogen.

In another general aspect, a gas diffusion electrode for carbon dioxide conversion includes: a porous support, and the silver nanocluster catalyst according to an exemplary embodiment of the present invention immobilized in pores of the porous support, wherein the porous support may be a carbon body, and the porous support may have an average pore size of 10 to 1000 nm.

In an exemplary embodiment of the present invention, a silver nanocluster used in the gas diffusion electrode for carbon dioxide conversion may have an average particle size of 1 to 5 nm, and the silver nanocluster catalyst may be supported at a density of 1 to 100 nmol/$cm^2$ per unit area of the porous support.

In another general aspect, a zero-gap reactor for carbon dioxide conversion includes: an anode; a cathode including the silver nanocluster according to an exemplary embodiment; and a separator placed between the cathode and the anode.

The cathode may be disposed in contact with one surface of the separator, the anode may be one or two or more selected from nickel, iron, and iridium, and the separator may be an ion exchange membrane.

In another general aspect, a method of converting carbon dioxide includes: supplying carbon dioxide to one surface of a cathode of the zero-gap reactor for carbon dioxide conversion according to an exemplary embodiment; and obtaining carbon monoxide converted from carbon dioxide, from the one surface of the cathode.

In still another general aspect, a method of preparing a silver nanocluster catalyst for carbon dioxide conversion represented by the following Chemical Formula 1 includes: mixing a silver precursor, a ligand compound, alkylammonium halide, and a reducing agent:

$$XAg_{14}(R^1)_{12} \quad \text{[Chemical Formula 1]}$$

wherein $R^1$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, C6-C20 arylalkyl, or S—$R^{11}$;

$R^{11}$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, or C6-C20 arylalkyl; and X is a halogen.

The ligand compound may be a C3-C20 alkynyl-based compound, a mole ratio of the silver precursor: the alkylammonium halide may be 1:0.01 to 0.5, and the silver precursor may be any one or two or more selected from $AgNO_3$, $AgBF_4$, $AgCF_3SO_3$, $AgClO_4$, $AgO_2CCH_3$, and $AgPF_6$.

Other features and aspects will be apparent from the following detailed description, the drawings, and the claims.

DETAILED DESCRIPTION OF EMBODIMENTS

Figure 1:
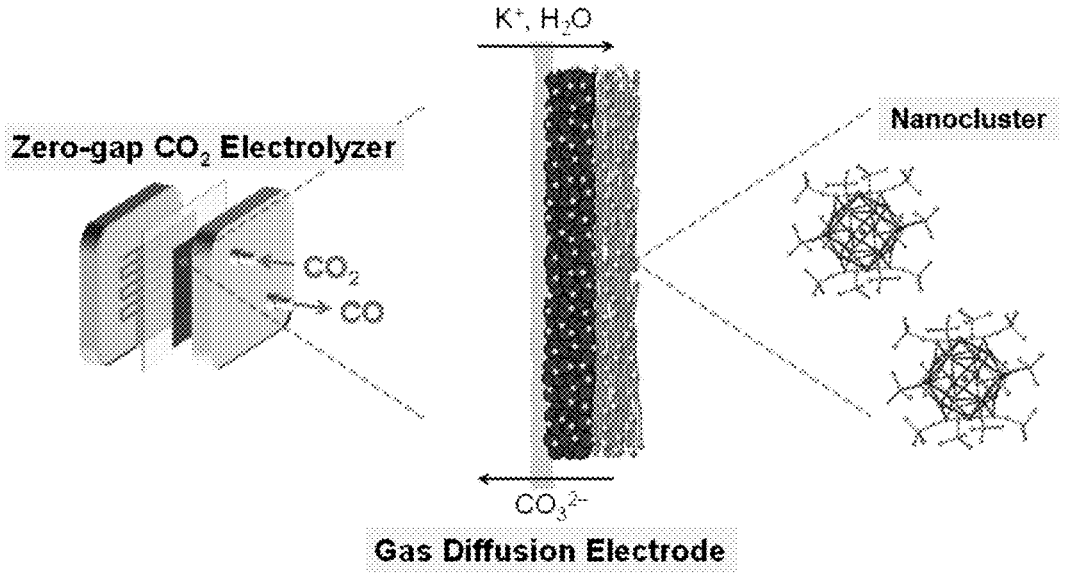
FIG. 1 is a schematic diagram showing a zero-gap reactor including a gas diffusion electrode for carbon dioxide conversion.

Hereinafter, a silver nanocluster catalyst for carbon dioxide conversion, a gas diffusion electrode including the same, a zero-gap reactor including the same, and a method of converting carbon dioxide using the same of the present invention will be described in detail.

The singular form used in the present Inventive steel may be intended to also include a plural form, unless otherwise indicated in the context.

In addition, the numerical range used in the present invention includes all values within the range including the lower limit and the upper limit, increments logically derived in a form and span in a defined range, all double limited values, and all possible combinations of the upper limit and the lower limit in the numerical range defined in different forms. Unless otherwise defined in the specification of the present invention, values which may be outside a numerical range due to experimental error or rounding of a value are also included in the defined numerical range.

The term "comprise" described in the present invention is an open-ended description having a meaning equivalent to the term such as "is/are provided", "contain", "have", or "is/are characterized", and does not exclude elements, materials or processes which are not further listed.

"Alkyl" described in the present invention refers to a linear or branched acyclic hydrocarbon and may have 1 to 10 carbon atoms, preferably 1 to 6 carbon atoms. In addition, alkyl in another embodiment may have 1 to 3 carbon atoms.

"Alkenyl" described in the present invention refers to a saturated linear or branched acyclic hydrocarbon including at least one carbon-carbon double bond, and includes -vinyl, -allyl, -1-butenyl, -2-butenyl, -isobutylenyl, -1-pentenyl, -2-pentenyl, -3-methyl-1-butenyl, -2-methyl-2-butenyl, -2,3-dimethyl-2-butenyl, -1-hexenyl, -2-hexenyl, -3-hexenyl, -1-heptenyl, -2-heptenyl, -3-heptenyl, -1-octenyl, -2-octenyl, -3-octenyl, -1-nonenyl, -2-nonenyl, -3-nonenyl, -1-dicenyl, -2-dicenyl, and -3-dicenyl, but is not limited thereto. The alkenyl group may be selectively substituted. Alkenyl includes a cis- and trans-oriented, or alternatively, E- and Z-oriented radical.

"Alkynyl" described in the present invention refers to a saturated linear or branched acyclic hydrocarbon having at least one carbon-carbon triple bond, and includes an ethynyl group, a propynyl group, a butynyl group, a butadiynyl group, a pentynyl group, a pentadiynyl group, a hexynyl group, a hexadiynyl group, and isomers thereof, but is not limited thereto.

"Cycloalkyl" described in the present invention refers to a monocyclic or polycyclic saturated ring which contains carbon and hydrogen atoms and no carbon-carbon multiple bond. It includes cyclopropyl, cyclobutyl, cyclopentyl, cyclohexyl, and cycloheptyl, but is not limited thereto. The cycloalkyl group may be selectively substituted. Furthermore, the cycloalkyl includes those linked by one or more heteroatom selected from B, O, N, C(=O), P, P(=O), S, $S(=O)_2$, and Si atoms.

"Halogen" described in the present invention refers to fluorine, chlorine, bromine, or iodine.

"Aryl" described in the present invention refers to a carbocyclic aromatic group containing 5 to 20 ring atoms. A representative example thereof includes phenyl, tolyl, xylyl, naphthyl, tetrahydronaphthyl, anthracenyl, fluorenyl, indenyl, azulenyl, and the like, but is not limited thereto. Furthermore, aryl includes carbocyclic aromatic groups being linked by alkylene or alkenylene or being linked by one or more heteroatoms selected from B, O, N, C(=O), P, P(=O), S, $S(=O)_2$, and Si atoms.

The number of carbons described in the present invention does not include the number of carbons of substituents, and as an example, C1-C10 alkyl refers to alkyl having 1 to 10 carbon atoms which does not include the number of carbons of the substituents of the alkyl.

Hereinafter, the present invention will be described in detail. Here, technical terms and scientific terms used in the present specification have the general meaning understood by a person skilled in the art unless otherwise defined, and the description for the known function and configuration obscuring the present invention will be omitted in the following description.

A carbon dioxide conversion technology by electrochemical reduction is performed as in the following Reaction Formula 1, and a carbon dioxide reduction reaction is performed in an aqueous electrolyte solution. Since reduction potential regions of hydrogen and carbon dioxide generated from the aqueous solution are similar to each other, a carbon dioxide reduction reaction and hydrogen generation may occur simultaneously, and thus, the selectivity thereof may be a very important problem.

$$CO_2+e^-+H_2O \rightarrow COOH^*+OH^- 0\ 120\ mVdec^{31\ 1}$$

$$COOH^*+e^- \rightarrow CO^*+OH^-\ 40\ mVdec^{-1}$$

$$CO^* \rightarrow CO\ 30\ mVdec^{-1}$$

Besides, though a gold catalyst is mainly used as an electrode catalyst, it is expensive and has limited reserves and a catalyst to replace it is needed, and thus, the present inventors intensified a study thereof, and as a result, found that the silver nanocluster of the present invention is inexpensive, has uniform uniformity, and has excellent selectivity for carbon dioxide reduction, thereby completing the present invention The present invention provides a silver nanocluster catalyst for carbon dioxide conversion represented by the following Chemical Formula 1:

$$XAg_{14}(R^1)_{12} \qquad \text{[Chemical Formula 1]}$$

wherein $R^1$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, C6-C20 arylalkyl, or S—$R^{11}$;

$R^{11}$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, or C6-C20 arylalkyl; and X is a halogen.

The silver nanocluster of the present invention has a structure composed of a specific number of atoms and ligands, and has excellent activity for a conversion reaction of carbon dioxide, has better stability than a conventional gold (Au)-based catalyst, is inexpensive, has excellent uniformity, and thus, is very useful as a catalyst for carbon dioxide conversion.

In Chemical Formula 1, $R^1$ may be C1-C10 alkyl, C3-C10 alkenyl, C3-C10 alkynyl, C6-C10 allyl, C3-C10 cycloalkyl, C5-C10 heteroallyl, C3-C10 heterocycloalkyl, C6-C10 arylalkyl, or S—$R^{11}$, $R^{11}$ may be C1-C10 alkyl, C3-C10 alkenyl, C3-C10 alkynyl, C6-C10 allyl, C3-C10 cycloalkyl, C5-C10 heteroallyl, C3-C10 heterocycloalkyl, or C6-C10 arylalkyl, and X may be a halogen.

In addition, in Chemical Formula 1 according to an exemplary embodiment of the present invention, $R^1$ may be C1-C10 alkyl, C3-C10 alkenyl, C3-C10 alkynyl, C6-C10 allyl, or S—$R^{11}$ and $R^{11}$ may be C1-C10 alkyl, C3-C10 alkenyl, C3-C10 alkynyl, C6-C10 allyl, or C6-C10 arylalkyl, specifically, in Chemical Formula 1, $R^1$ may be C1-C10 alkyl, C3-C10 alkenyl, or C3-C10 alkynyl, and more specifically, in Chemical Formula 1, $R^1$ may be C3-C7 alkynyl.

The present invention provides a gas diffusion electrode for carbon dioxide conversion, which may include a porous support, and a silver nanocluster catalyst according to an exemplary embodiment of the present invention immobilized in pores of the porous support.

The porous support may be used without limitation as long as it is a conductive porous support as a microporous layer (MPL), and specifically, may be a carbon body. A specific example of the carbon body may be one or two or more selected from carbon black, carbon nanotubes, graphene, carbon nanofiber, and graphitized carbon black, and more specifically, may be carbon black, but is not limited thereto.

In addition, the porous support may have an average pore size of 10 to 1000 nm, specifically 10 to 500 nm, and more specifically 10 to 100 nm, but is not limited thereto.

In an exemplary embodiment of the present invention, a silver nanocluster used in the gas diffusion electrode for carbon dioxide conversion may have an average particle size of 1 to 5 nm, and the silver nanocluster catalyst may be supported at a density of 1 to 100 nmol/$cm^2$, preferably 1 to 50 nmol/$cm^2$, and more preferably 1 to 30 nmol/$cm^2$ per unit area of the porous support.

A method of supporting a metal nanocluster on a porous support according to an exemplary embodiment may be a method of preparing a solution in which a metal nanocluster is dispersed in the porous support, dropping the solution, performing drying, and performing a heat treatment. The method allows easy application on the entire area of the support by capillarity, only by dropping a metal nanocluster dispersion to a porous support, and performs uniform coating and stable support. A solvent used herein may be any solvent which may be used within a range recognized by a person skilled in the art, and specifically, may be one or two or more selected from ethanol, methanol, isopropanol, butanol, pentanol, hexanol, dichloromethane, hexane, acetone, ethylene glycol, diethylene glycol, glycerol, and propylene glycol, but is not limited thereto.

Since the metal nanocluster is included as a catalyst compound of the cathode, molecular level dispersion and adsorption may be performed in the pores of the porous support as compared with a common metal nanoparticle catalyst. Accordingly, a cathode including the metal nanocluster may have significant electrochemical carbon dioxide conversion properties as compared with a cathode including a metal nanoparticle catalyst.

In addition, in an exemplary embodiment of the present invention, the cathode may reduce carbon dioxide into carbon monoxide. More specifically, the zero-gap reactor of the present invention is as shown in the schematic diagram of FIG. 1, in which carbon dioxide supplied to a cathode is converted into carbon monoxide and released. As an electrolyte of the zero-gap reactor, a KCl, NaOH, or KOH aqueous solution may be used, and the electrolyte may be specifically pH 7 to 14, and more specifically pH 8 to 14.

The concentration of the aqueous solution may be 0.1 to 10 M, specifically 0.5 to 5 M, and more specifically 0.5 to 3 M, but is not limited thereto.

The present invention provides a zero-gap reactor for carbon dioxide conversion, and the zero-gap reactor may include: an anode; a cathode including the silver nanocluster according to an exemplary embodiment; and a separator placed between the cathode and the anode.

The gas diffusion electrode including the silver nanocluster and the zero-gap reactor including the same of the present invention are systems which show excellent performance as compared with the case of carbon dioxide conversion using a conventional flow electrolyzer, and have very improved selectivity to a conversion reaction of carbon dioxide.

The separator may be placed in a sandwich form between the cathode and the anode, the cathode may be disposed in contact with one surface of the separator, and specifically, the separator may be disposed in contact with a microporous layer (MPL) of the gas diffusion electrode including the silver nanocluster which is the cathode.

The anode is a conductive metal, and specifically, may be one or two or more selected from nickel, iron, and iridium. More specifically, the anode may be a conductive metal form, and for example, a porous nickel form, but is not limited thereto.

The separator should have durability in a strong base environment and may use a material having low gas permeability and also high ion conductivity, and in an exemplary embodiment, the separator may be an ion exchange membrane. The ion exchange membrane may be manufactured from an ion exchange resin and ionomer known in the art, or use a purchased film. For example, a Nafion™ series membrane which is a polymer containing an overfluorinated sulfonic acid group, available from DuPont, USA may be used, and as a commercial film similar to this, Aquivion PFSA membrane available from Solvey, a Fumasep ion exchange membrane including cation and anion exchange membrane available from Fumatek, an anion exchange membrane available from Dioxide Materials, an anion exchange membrane available from Orion Polymer, an Aciplex-S membrane available from Asahi Chemicals, a Dow membrane available from Dow Chemicals, a Flemion membrane available from Asahi Glass, a GoreSelect membrane available from Gore & Associate, and the like may be used, but the present invention is not limited thereto.

The present invention provides a method of converting carbon dioxide, and the method may include: supplying carbon dioxide to one surface of a cathode of the zero-gap reactor for carbon dioxide conversion according to an exemplary embodiment of the present invention; and obtaining carbon monoxide converted from carbon dioxide, from the one surface of the cathode.

When the gas diffusion electrode for a carbon dioxide conversion reaction and the zero-gap reactor including the same of the present invention are used, carbon dioxide may be effectively converted with high selectivity and conversion rate.

The method of preparing a silver nanocluster catalyst for carbon dioxide conversion represented by the following Chemical Formula 1 may include: mixing a silver precursor, a ligand compound, alkylammonium halide, and a reducing agent:

$$XAg_{14}(R^1)_{12} \quad \text{[Chemical Formula 1]}$$

wherein $R^1$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, C6-C20 arylalkyl, or S—$R^{11}$;

$R^{11}$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, or C6-C20 arylalkyl; and X is a halogen.

Specifically, the ligand compound may be a C3-C20 alkynyl-based compound, C3-C10 alkynyl-based compound, or C3-C7 alkynyl-based compound. A mole ratio of the silver precursor : the ligand compound may be 1:0.1 to 10, preferably 1:0.2 to 7, and more preferably 1:0.5 to 5. Within the range, synthesis efficiency is excellent and reaction impurities may be decreased, which is thus preferred.

In the method of preparing a catalyst according to an exemplary embodiment, a mole ratio of the silver precursor : the reducing agent may be 1:0.1 to 10, preferably 1:0.2 to 7, and more preferably 1:0.5 to 5, but is not limited thereto.

In addition, a mole ratio of the silver precursor: the alkylammonium halide may be 1:0.01 to 0.5, preferably 1:0.02 to 0.3, and more preferably 1:0.03 to 0.2.

In an exemplary embodiment, the silver precursor may be any one or two or more selected from $AgNO_3$, $AgBF_4$, $AgCF_3SO_3$, $AgClO_4$, $AgO_2CCH_3$, and $AgPF_6$, specifically any one or two or more selected from $AgNO_3$, $AgBF_4$, and $AgPF_6$, and more specifically, $AgNO_3$ or $AgBF_4$, but is not limited thereto.

In an exemplary embodiment, the preparation method may further include a solvent, and the solvent may be used without limitation as long as it is commonly used in the art. As a specific example, it may be one or a mixed solvent of two or more selected from C1-C5 alcohol, acetonitrile, dimethylsulfoxide, dimethylformamide, acetone, tetrahydrofuran, and 1,4-dioxane, and preferably tetrahydrofuran, but is not limited thereto.

In addition, the method of preparing the silver nanocluster according to an exemplary embodiment may further include a step of precipitation and separation with a non-polar solvent, and the non-polar solvent used herein may be one or two or more selected from n-pentane, n-hexane, n-heptane, cyclopentane, cyclohexane, cycloheptane, cyclooctane, cis-cyclooctene, toluene, m-, o-, p-xylene, t-butylmethyl ether, and di-n-butyl ether, specifically, one or two or more selected from n-pentane, n-hexane, n-heptane, cyclopentane, cyclohexane, cycloheptane, cyclooctane, and cis-cyclooctene, and more specifically, one or two or more selected from n-pentane, n-hexane, and n-heptane, but is not limited thereto.

The alkylammonium halide may be C10-C30 alkylammonium halide, preferably C12-C20 alkylammonium halide, and more preferably C14-C18 alkylammonium halide.

The reducing agent may be one or two or more selected from triethylamine, oleylamine, carbon monoxide, and sodium borohydride, and specifically, may be triethylamine, but is not limited thereto.

Hereinafter, the silver nanocluster catalyst for carbon dioxide conversion, the gas diffusion electrode including the same, the zero-gap reactor including the same, and the method of converting carbon dioxide using the same according to the present invention will be described in more detail, by the specific example.

However, the following examples are only a reference for describing the present invention in detail, and the present invention is not limited thereto and may be implemented in various forms. In addition, the terms used herein are only for effectively describing certain examples, and are not intended to limit the present invention.

PREPARATION EXAMPLE 1

0.097 g (0.5 mmol) of $AgBF_4$, 0.061 mL (0.5 mmol) of t-butylacetylene, 0.070 mL (0.5 mmol) of triethylamine, and 0.011 g (0.04 mmol) of tetrabutylammonium chloride were added to a flask, 1 mL of tetrahydrofuran was added thereto, and stirring was performed for 4 hours. The solvent was removed by distillation under reduced pressure, impurities were removed by washing with pure water and n-pentane, and then a $[Ag_{14}(C{\equiv}CtBu)_{12}Cl]^+$ nanocluster was obtained.

Figure 2:
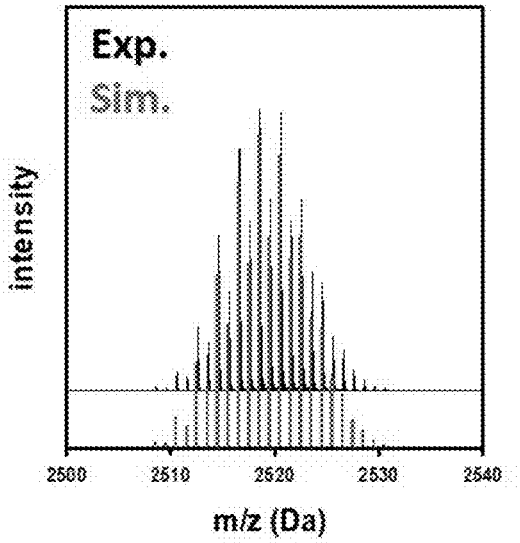
FIG. 2 is a drawing showing the results of ESI-MS of Preparation Example 1.

FIG. 2 shows a graph analyzing ESI-MS of the prepared nanocluster, which was confirmed to be matched the theoretical value.

Figure 3:
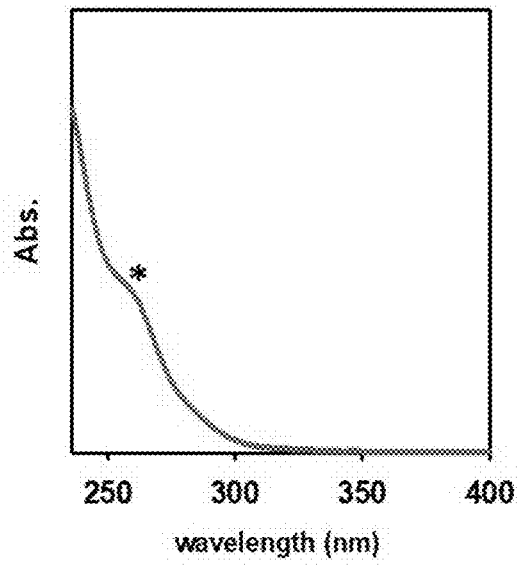
FIG. 3 is a drawing showing the results of UV-vis spectrum of Preparation Example 1.

FIG. 3 shows the analysis of the UV-vis spectrum of the prepared nanocluster.

EXAMPLE 1

A solution in which 170 μg of the $[Ag_{14}(C{\equiv}CtBu)_{12}Cl]^+$ nanocluster of Preparation Example 1 was dissolved in 160 μL of dichloromethane and 160 μL of acetone were mixed, and ultrasonic dispersion was performed for about 1 minute to prepare a nanocluster composite dispersion. Next, the nanocluster composite dispersion prepared above was solution-deposited on a gas diffusion-type microporous carbon electrode (GDE (W1S1011, Ce-Tech)) having an area of 2.5×2.5 $cm^2$ to manufacture a nanocluster composite gas diffusion electrode, and an average loading amount of the nanocluster was measured as 10.6 $nmol/cm^2$.

The gas diffusion electrode manufactured above was used as a cathode and a Ni foam (NiF, 29-04275-01, Invisible Inc.) having an area of 3×3 $cm^2$ was used as an anode, an AEM (Sustainion® X37-50, RT grade, Dioxide Materials) separator which was pretreated with 1.0 M KOH was placed between the cathode and the anode, and a stainless steel was used to perform compression to manufacture a zero-gap reactor.

EXAMPLES 2 TO 6

The zero-gap reactors of Examples 2 to 6 were manufactured in the same manner as in Example 1, except that the amount of the nanocluster of Preparation Example 1 was 85 μg (Example 2), 34 μg (Example 3), 10.2 μg (Example 4), 6.8 m (Example 5), and 3.4 μg (Example 6) instead of 170 m of Example 1.

COMPARATIVE EXAMPLE 1

The process was performed in the same manner as in Example 1, except that 500 μg of $Au_{25}(SC_6H_{13})_{18}$ was used instead of the nanocluster of Preparation Example 1.

COMPARATIVE EXAMPLE 2

A solution in which 170 μg of the $[Ag_{14}(C{\equiv}tBu)_{12}Cl]^+$ nanocluster of Preparation Example 1 was dissolved in 160 82 L of dichloromethane and 160 μL of acetone were mixed, and ultrasonic dispersion was performed for about 1 minute to prepare a nanocluster composite dispersion. Next, the nanocluster composite dispersion prepared above was solution-deposited on a gas diffusion-type microporous carbon electrode (GDE (W1S1011, Ce-Tech)) having an area of 2.5×2.5 $cm^2$ to manufacture a nanocluster composite gas diffusion electrode, which was used as a cathode, thereby manufacturing a conventional flow electrolyzer.

Figure 8:
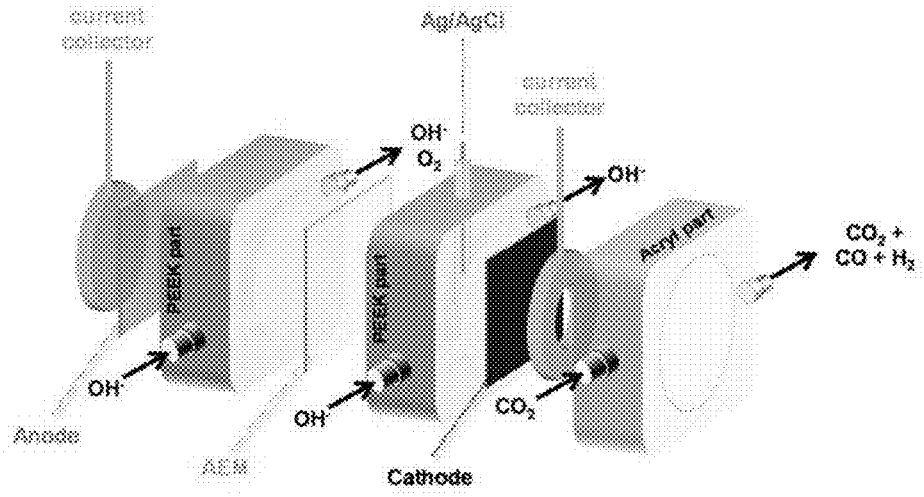
FIG. 8 is a schematic diagram showing a flow electrolyzer including a gas diffusion electrode for carbon dioxide conversion.

The cathode was fixed to a reduction electrode PEEK part with a donut-shaped stainless steel, and a Ni foam (NiF, 29-04275-01, Invisible Inc.) anode having an area of 2.5×2.5 $cm^2$ was fixed to an oxidation electrode PEEK part with a disc-shaped stainless steel. At this time, a reaction area of each electrode was limited to 2 $cm^2$ by the stainless steel. An AEM (Sustainion® X37-50, RT grade, Dioxide Materials) separator which was pretreated with 1.0 M KOH was placed between a cathode and an anode. The reactor was arranged in the order of gas flow Acryl part—reduction electrode PEEK part—AEM separator—oxide electrode PEEK part, as shown in the schematic diagram of FIG. 8, and was fastened with bolts and nuts to manufacture a flow electrolyzer.

EXPERIMENTAL EXAMPLE 1

The zero-gap reactors of Examples 1 to 6 and Comparative Example 1 were used to perform carbon dioxide conversion.

While $CO_2$ gas including water vapor was supplied at 30 sccm to the cathode, a 1.0 M KOH solution was circulated at a flow velocity of 3 mL/min. A cold trap was installed in an outlet of the cathode to remove moisture generated from the water vapor, and finally, a gas chromatograph was connected thereto analyze a final product.

Figure 4:
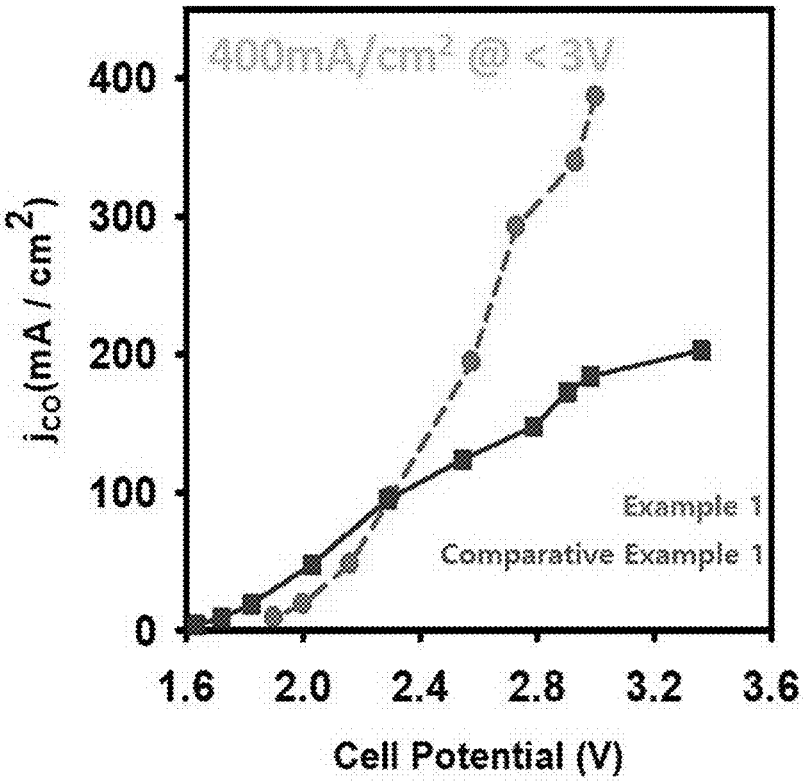
FIG. 4 is a drawing showing carbon dioxide conversion rates of Example 1 and Comparative Example 1.
Figure 5:
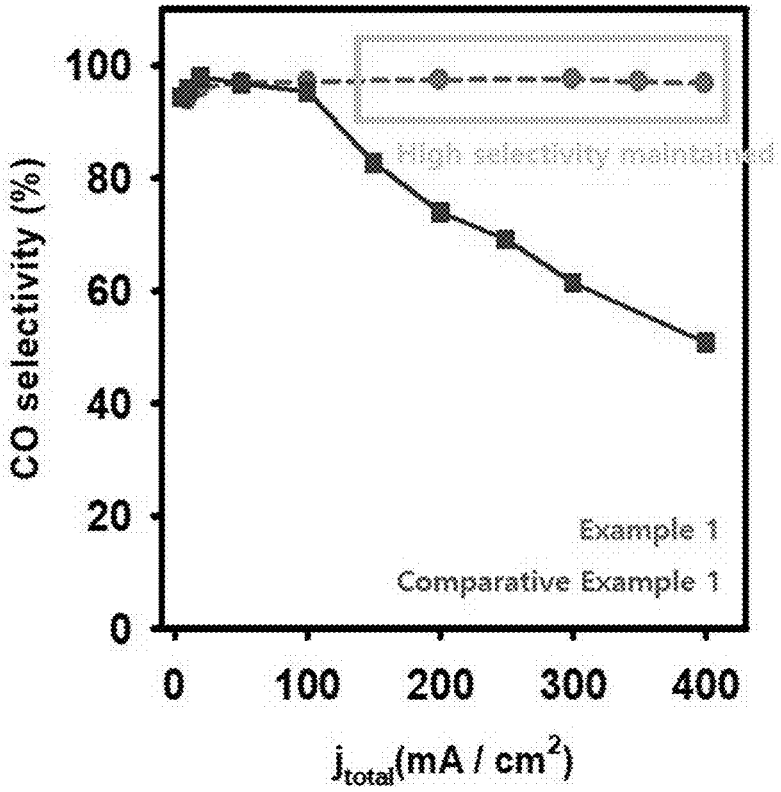
FIG. 5 is a drawing showing selectivity of a carbon dioxide conversion reaction of Example 1 and Comparative Example 1.

FIGS. 4 and 5 show the results of carbon dioxide conversion rates and the selectivity for the carbon dioxide conversion reaction of Example 1 and Comparative Example 1, and it was found that Example 1 including the silver nanocluster of the present invention showed a significantly improved carbon dioxide conversion rate and excellent selectivity for the carbon dioxide conversion reaction even at a high current density, as compared with Comparative Example 1.

Figure 6:
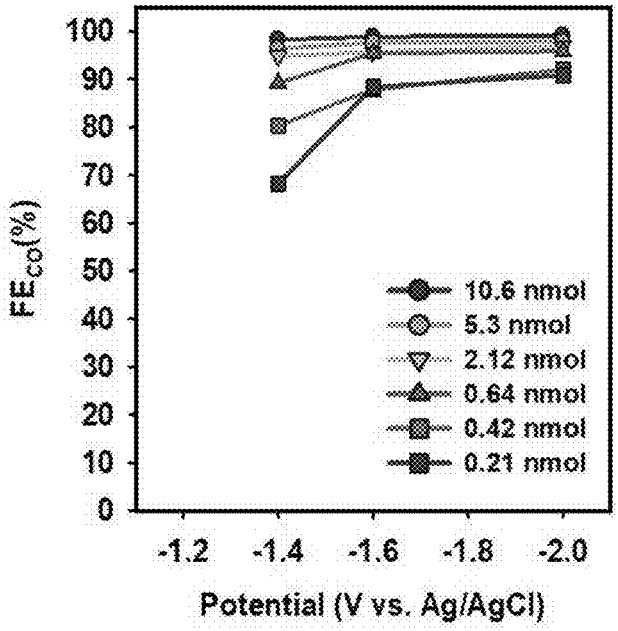
FIG. 6 is a drawing showing selectivity of a carbon dioxide conversion reaction of Examples 1 to 6.

In addition, FIG. 6 shows the results of the selectivity for the carbon dioxide conversion reaction of Examples 1 to 6, and Example 3 including the amount of the silver nanocluster catalyst of the present invention decreased by 20% also maintained the selectivity for the carbon dioxide conversion reaction excellently, and thus, it was found that excellent carbon dioxide conversion performance was shown even with a very small amount of catalyst.

EXPERIMENTAL EXAMPLE 2

The experiment for carbon dioxide conversion was performed in the same manner as in Experimental Example 1, except that Example 1 and Comparative Example 2 were used instead of Examples 1 to 6 and Comparative Example 1.

Figure 7:
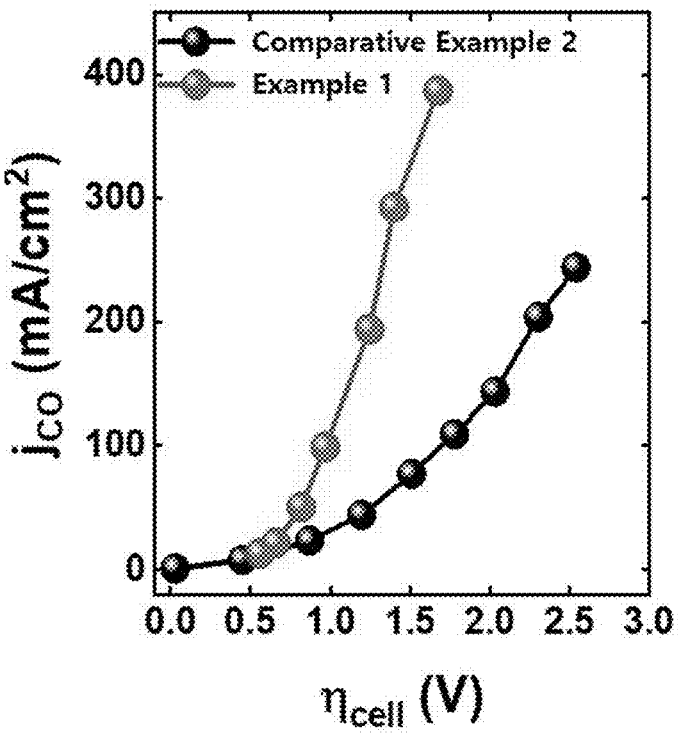
FIG. 7 is a drawing showing carbon dioxide conversion rates of Example 1 and Comparative Example 2.

FIG. 7 shows the results of the carbon dioxide conversion rates of Example 1 and Comparative Example 2, and it was found that Example 1 using the zero-gap reactor of the present invention showed significantly improved carbon dioxide conversion rate as compared with Comparative Example 2 using a flow electrolyzer.

Thus, the silver nanocluster of the present invention shows very economical and excellent carbon dioxide conversion rate and selectivity for a carbon dioxide conversion reaction as compared with a conventional gold (Au)-based catalyst, and in particular, when the silver nanocluster is introduced to a zero-gap reactor, excellent carbon dioxide conversion selectivity is shown even at a high current density, and thus, it may be industrially easily used as a high-performance electrochemical carbon dioxide conversion system.

The silver nanocluster of the present invention has a structure composed of a specific number of atoms and ligands, and has excellent activity for a conversion reaction of carbon dioxide, has better stability than a conventional gold (Au)-based catalyst, is inexpensive, has excellent uniformity, and thus, is very useful as a catalyst for carbon dioxide conversion.

The gas diffusion electrode including the silver nanocluster and the zero-gap reactor including the same of the present invention are systems which show excellent performance as compared with the case of carbon dioxide conversion using a conventional flow electrolyzer, and have very improved selectivity to a conversion reaction of carbon dioxide.

Therefore, when the gas diffusion electrode for a carbon dioxide conversion reaction and the zero-gap reactor including the same of the present invention are used, carbon dioxide may be effectively converted with high selectivity and conversion rate.

Hereinabove, although the present invention has been described by specific matters, the examples, and the comparative examples, they have been provided only for assisting in the entire understanding of the present invention. Therefore, the present invention is not limited to the above examples. Various modifications and changes may be made by those skilled in the art to which the present invention pertains from this description.

Therefore, the spirit of the present invention should not be limited to the above-described exemplary embodiments, and the following claims as well as all modifications equal or equivalent to the claims are intended to fall within the scope and spirit of the invention.

The invention claimed is:

1. A silver nanocluster catalyst for carbon dioxide conversion represented by the following Chemical Formula 1:

$$XAg_{14}(R^1)_{12} \quad \text{[Chemical Formula 1]}$$

wherein $R^1$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, C6-C20 arylalkyl, or S—$R^{11}$;

$R^{11}$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, or C6-C20 arylalkyl; and X is a halogen.

2. The silver nanocluster catalyst for carbon dioxide conversion of claim 1, wherein in Chemical Formula 1, $R^1$ is C1-C10 alkyl, C3-C10 alkenyl, C3-C10 alkynyl, C6-C10 allyl, C3-C10 cycloalkyl, C5-C10 heteroallyl, C3-C10 heterocycloalkyl, C6-C10 arylalkyl, or S—$R^{11}$;

$R^{11}$ is C1-C10 alkyl, C3-C10 alkenyl, C3-C10 alkynyl, C6-C10 allyl, C3-C10 cycloalkyl, C5-C10 heteroallyl, C3-C10 heterocycloalkyl, or C6-C10 arylalkyl; and X is halogen.

3. The silver nanocluster catalyst for carbon dioxide conversion of claim 1, wherein in Chemical Formula 1, $R^1$ is C1-C10 alkyl, C3-C10 alkenyl, C3-C10 alkynyl, C6-C10 allyl, or S—$R^{11}$;

$R^{11}$ is C1-C10 alkyl, C3-C10 alkenyl, C3-C10 alkynyl, C6-C10 allyl, or C6-C10 arylalkyl; and X is halogen.

4. The silver nanocluster catalyst for carbon dioxide conversion of claim 1, wherein in Chemical Formula 1, $R^1$ is C1-C10 alkyl, C3-C10 alkenyl, or C3-C10 alkynyl; and X is halogen.

5. A gas diffusion electrode for carbon dioxide conversion comprising: a porous support, and the silver nanocluster catalyst of claim 1 immobilized in pores of the porous support.

6. The gas diffusion electrode for carbon dioxide conversion of claim 5, wherein the porous support is a carbon body.

7. The gas diffusion electrode for carbon dioxide conversion of claim 5, wherein the porous support has an average pore size of 10 to 1000 nm.

8. The gas diffusion electrode for carbon dioxide conversion of claim 5, wherein the silver nanocluster has an average particle size of 1 to 5 nm.

9. The gas diffusion electrode for carbon dioxide conversion of claim 5, wherein the silver nanocluster catalyst is supported at a density of 1 to 100 nmol/$cm^2$ per unit area of the porous support.

10. A zero-gap reactor for carbon dioxide conversion comprising: an anode; a cathode including the silver nanocluster of claim 1; and a separator placed between the cathode and the anode.

11. The zero-gap reactor for carbon dioxide conversion of claim 10, wherein the cathode is disposed in contact with one surface of the separator.

12. The zero-gap reactor for carbon dioxide conversion of claim 10, wherein the anode is one or two or more selected from nickel, iron, and iridium.

13. The zero-gap reactor for carbon dioxide conversion of claim 10, wherein the separator is an ion exchange membrane.

14. A method of converting carbon dioxide, the method comprising:

supplying carbon dioxide to one surface of a cathode of a zero-gap reactor for carbon dioxide conversion; and obtaining carbon monoxide converted from carbon dioxide, from the one surface of the cathode, wherein the zero-gap reactor for carbon dioxide conversion is the zero-gap reactor for carbon dioxide conversion of claim 10.

15. A method of preparing a silver nanocluster catalyst for carbon dioxide conversion, the method comprising: mixing a silver precursor, a ligand compound, alkylammonium halide, and a reducing agent to prepare a silver nanocluster represented by the following Chemical Formula 1:

$$XAg_{14}(R^1)_{12} \quad \text{[Chemical Formula 1]}$$

wherein $R^1$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, C6-C20 arylalkyl, or S—$R^{11}$;

$R^{11}$ is C1-C20 alkyl, C3-C20 alkenyl, C3-C20 alkynyl, C6-C20 allyl, C3-C20 cycloalkyl, C5-C20 heteroallyl, C3-C20 heterocycloalkyl, or C6-C20 arylalkyl; and X is a halogen.

16. The method of preparing a silver nanocluster catalyst for carbon dioxide conversion of claim 15, wherein the ligand compound is a C3-C20 alkynyl-based compound.

17. The method of preparing a silver nanocluster catalyst for carbon dioxide conversion of claim 15, wherein a mole ratio of the silver precursor: the alkylammonium halide is 1:0.01 to 0.5.

18. The method of preparing a silver nanocluster catalyst for carbon dioxide conversion of claim 15, wherein the silver precursor is any one or two or more selected from $AgNO_3$, $AgBF_4$, $AgCF_3SO_3$, $AgClO_4$, $AgO_2CCH_3$, and $AgPF_6$.

* * * * *